United States Patent [19]

Escaro et al.

[11] 4,022,162

[45] May 10, 1977

[54] BOILER HAVING A SEPARABLE FURNACE AND HEAT EXCHANGER

[75] Inventors: Jacques Escaro, Villemomble; Maurice Chevalier, Bretigny sur Orge, both of France

[73] Assignee: Societe Generale de Fonderie, Paris, France

[22] Filed: Nov. 21, 1975

[21] Appl. No.: 634,153

[52] U.S. Cl. ..... 122/182 T; 122/210; 122/214

[51] Int. Cl.[2] ..... F22B 7/12

[58] Field of Search ..... 122/167, 182 R, 182 T, 122/210, 214, 216, 218, 155 A

[56] References Cited

UNITED STATES PATENTS

| | | | |
|---|---|---|---|
| 2,311,657 | 2/1943 | Grindle | 122/182 X |
| 2,568,781 | 9/1951 | Watts | 122/182 |
| 2,779,315 | 1/1957 | Tucker | 122/214 X |
| 2,983,261 | 5/1961 | Smith | 122/218 |
| 3,052,220 | 9/1962 | Hany | 122/167 |
| 3,320,933 | 5/1967 | Baier | 122/218 |

*Primary Examiner*—Kenneth W. Sprague
*Attorney, Agent, or Firm*—Young & Thompson

[57] ABSTRACT

A boiler which is primarily designed for the central heating of apartments has two separable elements constituted by the boiler furnace and a heat exchanger. The heat exchanger of single-unit construction surmounts a completely open section of the boiler furnace and carries a gas or fuel-oil burner, the flame of which is directed away from the internal surface of the heat exchanger and follows a curved path within the combustion chamber. Except for the open section which carries the exchanger, the boiler furnace is completely surrounded by a jacket for the circulation of heat-transporting fluid.

7 Claims, 10 Drawing Figures

30
28
29
7
14a
I
X1
VII
28
VII
2
20
2a
9
10
8
P
P
12
13a
16
13
3
19
3b
15
1
I
X2

BOILER HAVING A SEPARABLE FURNACE AND HEAT EXCHANGER

This invention relates to a boiler which is primarily intended for central heating and especially for the heating of individual apartments which have low power requirements. The boiler under consideration can be heated with either fuel oil or gas and has a circulation system for the heat-transporting fluid. The boiler is also of the type comprising a separable heat exchanger and boiler furnace.

Boilers of this type are already known in which the boiler furnace and the heat exchanger are both of welded steel construction.

When the boiler is in service, the heat exchanger is placed above the furnace and forms an extension of the rectangular section of this latter whilst the burner is placed in the bottom portion of the furnace. The flame of the burner is directed horizontally and impinges on the opposite face of the furnace.

A boiler of this type is attended by a disadvantage in that it takes up considerable space in the vertical direction. Moreover, the welded steel design of the heat exchanger entails high construction costs and does not readily make it possible to obtain the rounded shapes which are conducive to good flow of the combustion gases.

The aim of the invention is to permit the construction of a compact boiler which is not subject to the drawbacks mentioned above, which can be installed without difficulty and which permits easy maintenance.

In accordance with the invention, the boiler which comprises a separable heat exchanger and boiler furnace, said heat exchanger being formed of cast iron and covering a completely open section of the furnace is distinguished by the fact that the heat exchanger is of single-unit construction and carries a burner in which the flame of said burner is directed away from said heat exchanger, and that the boiler furnace which is surrounded by heat-transporting fluid on all faces is completely closed when in service except for the open section which is covered by the heat exchanger.

This structure makes it possible to simplify the boiler furnace, the shape of which can thus be adapted to the combustion characteristics and ensure optimum development of the flame. Said structure also permits maximum exposure of the heat exchanger to the radiation of the combustion gases.

In a preferred embodiment of the invention, the heat exchanger is traversed by a series of flues surrounded by the heat-transporting fluid, said flues being each provided with a convergent portion followed by a divergent portion and intended to open into an external smoke-box placed on the heat exchanger.

The flame is thus curved back and its extension is reduced accordingly, thus making it possible to obtain minimum overall dimensions, for example in the vertical direction.

The burner can also be mounted in a removable and leak-tight manner through a passage formed in the heat exchanger outside the portion comprising the flues, thereby achieving greater ease of access to the burner.

Moreover, the heat exchanger is preferably placed above the boiler furnace in the service position, with the result that the burner and the smoke discharge chimney can be placed at the top, thus permitting more convenient installation and maintenance.

In accordance with a particular embodiment, the boiler furnace is constructed of cast iron and has a substantially rectangular boiler. There is thus obtained an extremely compact boiler, the shape of which makes it possible to incorporate the boiler in a kitchen equipment installation.

In accordance with another embodiment of the invention, the boiler furnace is constructed of sheet steel and its internal wall comprises a substantially cylindrical portion closed by domical bottom portion. There is thus obtained a light boiler which is also of small size and can readily be placed in an apartment.

Further particular features and advantages of the invention will become apparent from the following detailed description, a number of embodiments of the invention being illustrated in the accompanying drawings which are given by way of example without any limitation being implied, and in which.

Figures 1, 3, 4, 5, 6:
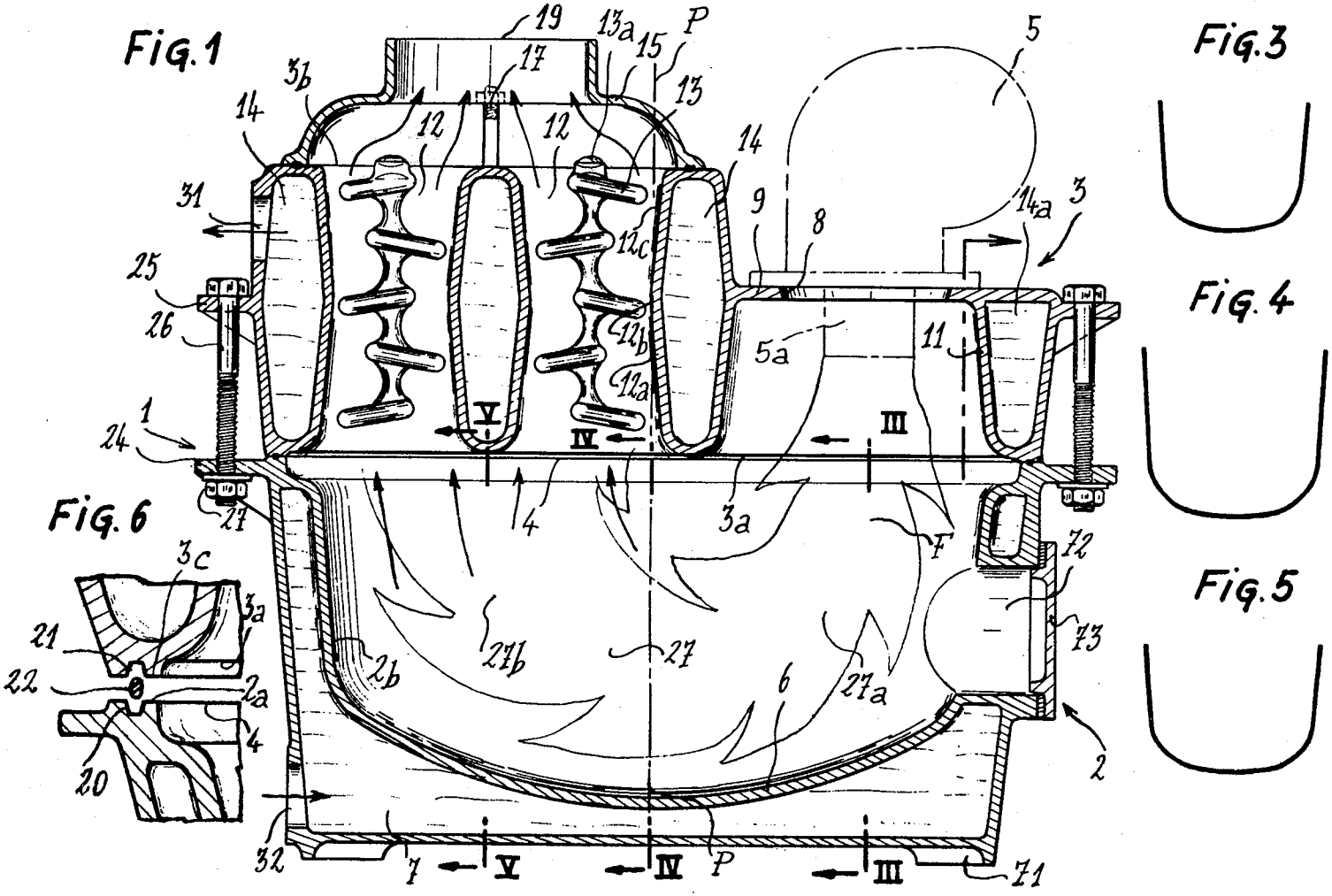
FIG. 1 is a view in elevation and in central cross-section taken along line I—I of FIG. 2 showing a first embodiment of a boiler in accordance with the invention.
FIGS. 3, 4 and 5 show tranverse profiles of the boiler furnace respectively along lines III—III, IV—IV and V—V of FIG. 1.
FIG. 6 is a detail sectional view of FIG. 1, this view being drawn to a much larger scale.

In the embodiment shown in FIGS. 1 to 7, the boiler 1 in accordance with the invention comprises a furnace 2 and a heat exchanger 3 which are both provided with a circulation of heat-transporting fluid and assembled together in a removable and separable manner. The heat exchanger 3 which is formed of monobloc cast-iron covers a substantially horizontal section 4 which is formed at the top of the boiler furnace 2 and is completely open.

The heat exchanger 3 carries a burner 5 of conventional type for gas or fuel oil which is so arranged that the burner flame is directed away from the internal surface of said heat exchanger 3 and towards the bottom wall 6 of the boiler furnace 2. Said boiler furnace is enclosed within a double-walled space 7 for the circulation of the heat-transporting fluid which surrounds the furnace on all its faces except for the face which constitutes the section 4. In the embodiment shown by way of example, the space 7 surrounds the bottom and lateral faces of the boiler furnace 2 and the burner which is shown diagrammatically at 5 is intended to burn fuel oil.

Looking from above, the shape of the heat exchanger 3 is substantially rectangular with a longitudinal plane of symmetry $X_1 1 - X_2$ corresponding to the line of cross-section I—I.

The heat exchanger 3 has dissymmetrical structure. A circular passage 8 is pierced in a substantially horizontal web 9 on one side of the heat exchanger. The burner 5 is engaged in the passage 8 in order to ensure that the flame F is initially oriented in a downward vertical direction. The burner 5 is secured to the web 9 by means of bolts (not shown in the drawings), said bolts being screwed into internally-threaded bores 10 formed at the periphery of the passage 8.

A vertical and slightly flared passage 11 forms a downward extension of the web 9 and surrounds a portion 5a of the burner 5 which is placed within the interior of the boiler.

Figures 2, 7:
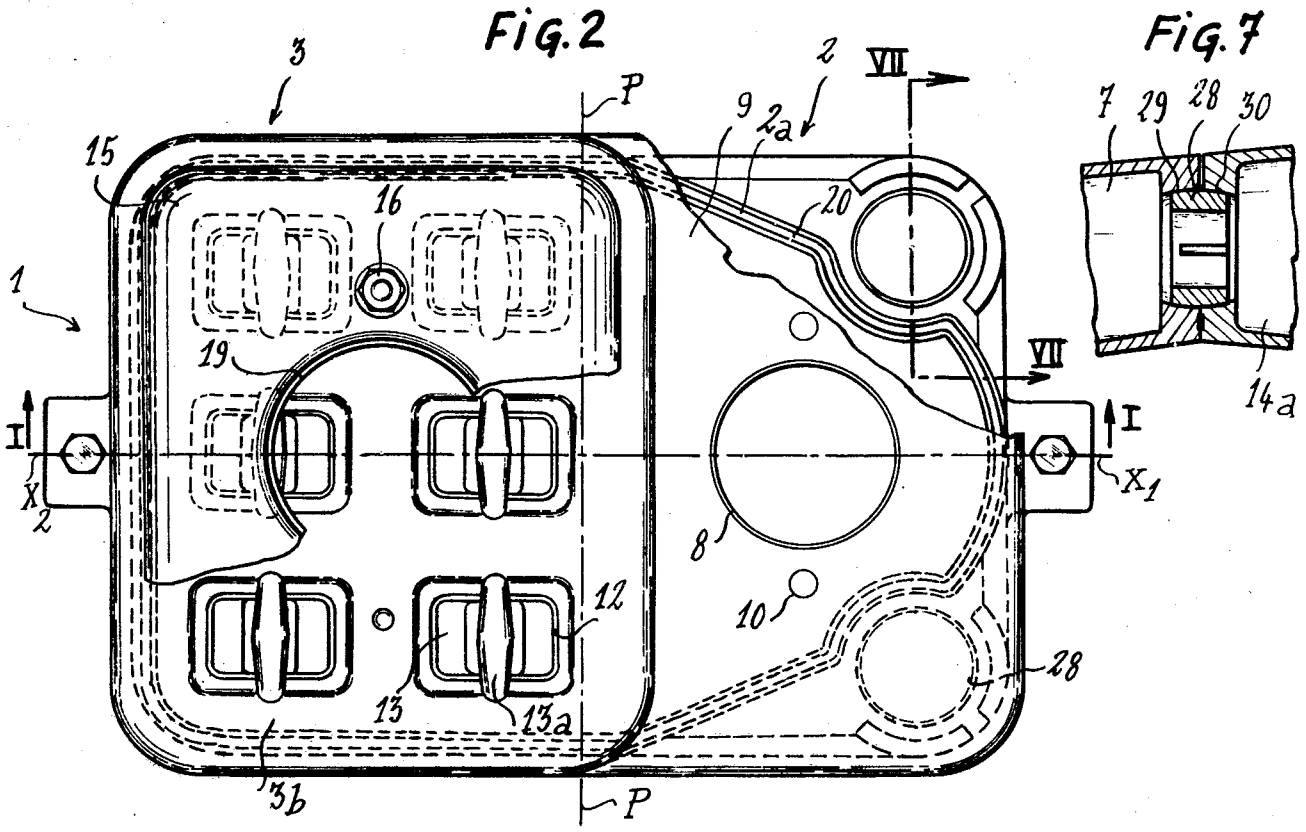
FIG. 2 is a fragmentary top view of the boiler of FIG. 1.
FIG. 7 is a part-sectional view of the boiler of FIG. 1, this view being taken along line VII—VII of FIG. 2.

On the other side, the heat exchanger 3 is traversed (as shown in FIG. 2) by a series of flues 12 having substantially vertical axes and rectangular cross-sections with rounded corners. As shown in FIGS. 1 and 2, the axis of the burner is parallel to those of the flues, said axes being parallel to the plane of symmetry $X_1$–$X_2$ of the furnace 2. The flues 12 each have a convergent lower portion $12_a$, a central throat $12_b$ located in the vicinity of the level of the web 9 and a divergent upper portion $12_c$.

Baffles 13 provided with projecting heads $13_a$ rest on the top edges of the flues 12 and are removably suspended within the interior of said flues 12.

A double-walled jacket 14 filled with heat-transporting fluid surrounds the flues 12 and also surrounds the passage 11 at $14_a$. Said jacket has a bottom face $3_a$ which is located slightly above the level of the section 4 and constitutes practically the entire heat exchanger surface which is oriented towards the furnace.

The flues 12 open into a smoke-box 15 which is placed above the heat exchanger 3 on a substantially flat top face $3_b$ which surrounds the top edges of said flues 12. Said smoke-box is applied against said face by means of nuts 16 screwed onto threaded tie-bolts 17 which are in turn engaged in internally-threaded bores formed in the face $3_b$. Lead-tightness is obtained by means of a peripheral seal, especially of asbestos. An orifice 19 for the connection of a chimney terminates the smoke-box 15 at the top portion of this latter. In a preferred form of construction, the face $3_b$ is trued by machining as well as the corresponding bearing surface of the smoke-box 15.

The furnace 2 and the heat exchanger 3 are provided respectively with clamping lugs 24 and 25 at the center of their short sides. In said lugs are engaged threaded tiebolts 26 which are tightened by means of nuts 27 in order to apply two joint surfaces $2_a$ and $3_c$ against each other; said surfaces are substantially horizontal in service and formed respectively on the furnace 2 at the level of the open section 4 and on the heat exchanger 3. Oppositely-facing grooves 20 and 21 are formed respectively in said two surfaces $2_a$ and $3_c$, a sealing strip 22 such as an asbestos cord being placed within said grooves.

The boiler furnace 2 has in plan a rectangular cross-section which is similar to that of the heat exchanger 3 and comprises the same plane of symmetry $X_1$–$X_2$. Said furnace has a cup-shaped internal wall $2_b$ which includes the bottom wall 6 and delimits a combustion chamber 27 for the propagation of the flame. The chamber 27 has a first portion $27_a$ of small width and height at the level of the burner 5 and extending from this latter to a central plane P located in the vicinity of the flues 12. The transverse cross-section of said portion $27_a$ increases progressively from the zone of the burner 5 (as shown in FIG. 3) to the central plane P (as shown in FIG. 4) since the width and the heighrt of said portion increase simultaneously.

The downstream portion $27_b$ of the chamber 27 relatively to the direction of progression of the flame F, that is, the portion located beyond the central plane P, retains a constant width but has a decreasing height as can be seen from a comparison of FIGS. 4 and 5.

Provision is made on each side of the narrow portion of the space $27_a$ externally of the joint surfaces $2_a$ and $3_c$ for two biconical rings 28 which may be partially split for establishing a communication between the double-walled water jackets 7 and $14_a$. FIG. 7 shows the assembly of one of said rings 28 which is forcibly fitted in two conical orifices 29 and 30 formed in oppositely-facing relation in substantially horizontal walls of the boiler furnace 2 and of the heat exchanger 3.

Moreover, two bores 31 and 32 respectively for the departure and return of heat-transporting fluid to and from the utilization appliances are formed respectively at the top of the heat exchanger 3 and at the bottom of the boiler furnace 2.

In the embodiment which is illustrated, the furnace 2 also has four base supports or feet 71 and a furnace cleaning orifice 72 which is closed in service by means of a detachable plate 73.

The operation of the boiler as thus constructed is as follows:

The combustion products delivered by the burner 5 form a flame F which progresses from the point of formation in a vertical downward motion within the narrow portion $27_a$ of the combustion chamber 27. Under the action of the downward and incurved shape of the bottom wall 7 within the space $27_a$, the direction of the flame F is progressively incurved until it becomes substantially horizontal as shown in FIG. 1.

As the combustion develops, the flame F encounters sections of increasing dimensions which permit progressive widening-out of the flame.

At the level of the plane P, the mean direction of the flame F is substantially horizontal and has then attained its full development. The flame F then passes through the space $27_b$ is an upwardly curved path in the direction of the flues 12 through transverse sections of constant width and slowly decreasing height corresponding to progressive discharges of burnt gases.

At the end of the path, the burnt gases are located opposite to the flues 12 and pass through these latter, flow around the baffles 13 and are finally discharged into the smoke-box 15.

The flow path thus formed permits optimum development of the flame F. In fact, the flame follows a downward path during its period of generation and of dynamic development and a natural upward path when it has attained its full development. In point of fact, this highly favorable combustion regime is obtained within a space of very small dimensions, especially in height.

Moreover, the heat exchanger is provided both with a bottom face $3_a$ which is directly exposed to heat transfer by radiation of the flame F and of the flues 12 for collecting the convection heat released by the burnt gases. Enhanced compactness of the entire unit is thereby achieved.

The boiler herein described also offers great ease of assembly, disassembly and maintenance. The elements constituted by the boiler furnace 2, the heat exchanger 3 and the burner 5 are in fact readily transportable even in locations which are not readily accessible and can be assembled by means of limited tooling equipment. In installed boilers, the position of the burner 5 at a distance from the axis permits good accessibility of this delicate component, with the result that disassembly and replacement of a damaged element can easily be carried out in the event of accident.

It is also worthy of not that, at the time of assembly, perfect relative positioning of the boiler furnace 2 and of the heat exchanger 3 is ensured by cooperation of the rings 28 and of the orifices 29 and 30.

By virtue of the advantages mentioned above, the boiler in accordance with the invention provides an excellent solution to the problem of individual central heating of apartments or flats.

Figure 8:
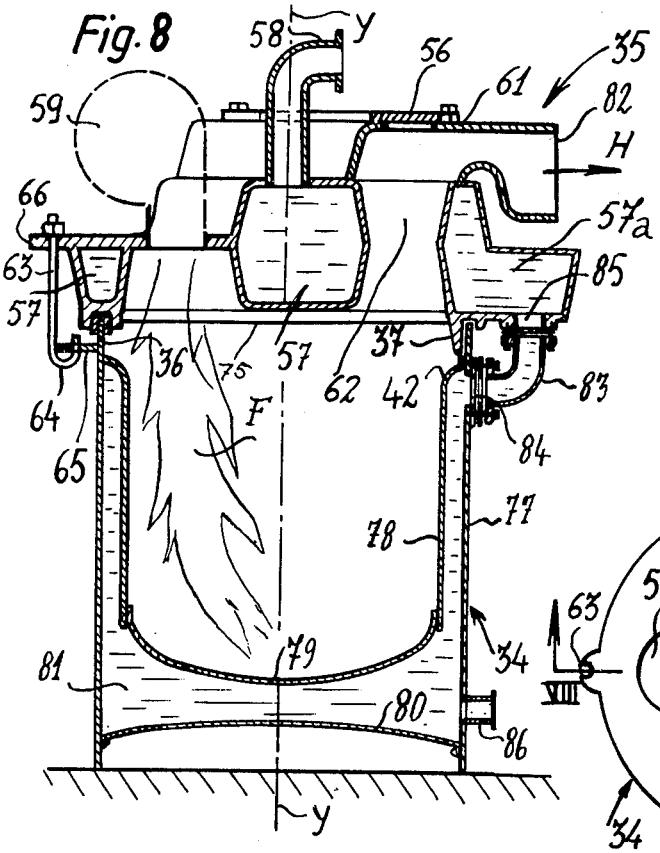
FIG. 8 is a sectional view in elevation taken along line VIII—VIII of FIG. 9 and showing a second embodiment of a boiler in accordance with the invention.
Figure 9:
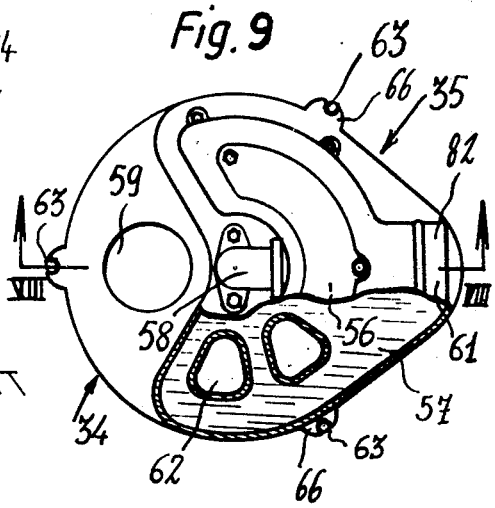
FIG. 9 is a fragmentary top view of the boiler of FIG. 8.
Figure 10:
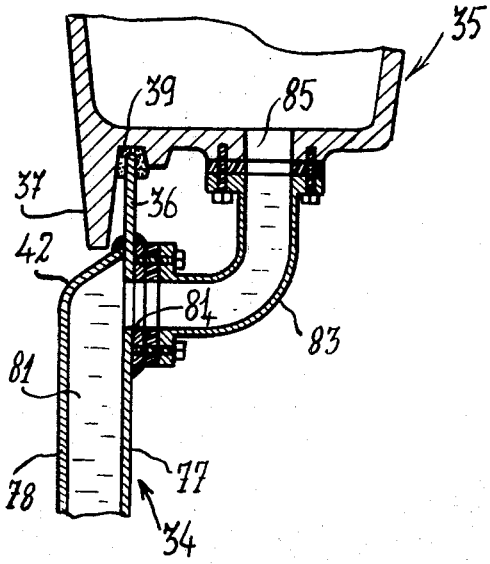
FIG. 10 is a partial enlargement of FIG. 8 showing a detail of connection between the heat exchanger and the boiler furnace.

In the embodiment which is illustrated in FIGS. 8 to 10, the boiler in accordance with the invention comprises a sheet steel furnace 34 surrounded on all faces by heat-transporting fluid except for a substantially horizontal open top section 75 covered by a single-piece cast-iron heat exchanger 35.

The furnace has a vertical axis of symmetry Y—Y in the service position. Two external and internal shells 77 and 78 respectively which are preferably joined by welding to two domical bottom walls 79 and 80 which are respectively concave and convex delimit the annular jacket 81 for the circulation of heat-transporting fluid. The jacket 81 is closed at the top by joining the rounded edge portion 42 to the shell 77, preferably by welding.

The heat exchanger 35 of substantially circular shape is provided in the bottom face thereof with a peripheral groove 39 (as shown in FIG. 10) and with a centering flange 37. Said heat exchanger is supported by a rib 36 which is engaged within said groove 39 with interposition of a seal. Three tie-bolts 63 which are threaded at one end and bent back to form a hook at the other end serve to join respectively three open lugs 66 placed on the heat exchanger 35 at angular intervals of 120° to three gusset-plates 65 which are welded opposite to said lugs 66 on the shell 77.

A burner 59 of conventional type having a downwardly directed vertical axis as well as a series of vertical convergent-divergent flues 62 are distributed about the axis Y—Y and pass through the heat exchanger 35. The flues 62 open into a smoke-box 61 which is bolted onto the heat exchanger 35 and are provided on the one hand with a lateral orifice 82 for the connection of a chimney and on the other hand with a detachable furnace-cleaning plate 56.

A space 57 for the circulation of heat-transporting fluid within the exchanger 35 surrounds the flues 62 and that portion of the burner 59 which is located inside the boiler; and a union elbow 83 puts said space 57 into communication with the circulation jacket 81 of the boiler furnace 34.

To this end, two openings 84 and 85 (shown in FIG. 10) having substantially horizontal and vertical axes respectively are formed in the shell 77 and in the bottom portion of a lateral projection 35*a* of the heat exchanger 35 and the two openings 84 and 85 are connected in leak-tight manner to the two ends of the union elbow 83 by means of bolted coupling flanges and seals of known type.

A connecting-pipe 58 for the discharge of hot heat-transporting fluid to the utilization system is placed at the top of the heat exchanger 35 in communication with the space 57 whilst a connecting-pipe 86 for the return of the cooled heat-transporting fluid is placed at the bottom of the shell 77 in communication with the jacket 81.

During operation, the burner produces a flame F which is directed vertically downwards and progressively widens as the combustion takes place while passing downwards within the boiler furnace 34. The burnt gases which are discharged from the flame move upwards annularly towards the flues 62, pass through these latter in order to be delivered into the smoke-box 61 and are discharged into the chimney through the lateral orifice 82.

The advantages of small overall size, good development of the flame and natural discharge of burnt gases are again met with in this case.

It may be noted in addition that the steel construction of the boiler furnace makes it possible to obtain a reduction in weight without adversely affecting either the cost of manufacture by virtue of the simple shapes adopted or, as has just been seen, the quality of combustion. Moreover, the cast-iron construction of the heat exchanger permits progressive shapes which are necessary in order to permit good flow of the gases, especially within the flues.

The invention is not limited to the embodiments which have been described in the foregoing and many alternative forms may be devised.

In particular, the open section of the boiler furnace could be placed vertically and not horizontally. The axis of the burner and the axes of the flues would in that case be placed horizontally, the boiler furnace and the heat exchanger being displaced through an angle of 90°.

We claim:

1. A boiler which is primarily intended for central heating and especially for the heating of individual apartments having low power requirements, said boiler being heated with gas or fuel-oil associated with a circulation of heat-transporting fluid and comprising a boiler furnace, a separable heat exchanger and a burner, the boiler furnace having a completely open section and a jacket through which the heat-transporting fluid is circulated, said jacket surrounding the furnace except for said open section, the heat exchanger carrying the burner and being removably mounted in use on the boiler furnace so as to cover said open section of said boiler furnace, said heat exchange comprising a series of flues and a jacket containing said heat-transporting fluid and surrounding the flues, the flame of said burner being directed away from the heat exchanger and the burner being located off-center with respect to the heat exchanger and the boiler furnace.

2. A boiler according to claim 1, wherein the flues comprise central portions and wherein the heat exchanger comprises means for removably mounting the burner, said means being located in the vicinity of the level of the central portion of the flues.

3. A boiler according to claim 1, wherein the heat exchanger comprises a bottom face substantially perpendicular to the burner and to the flues, said bottom face being located in the vicinity of the level of the open section of the boiler furnace.

4. A boiler according to claim 1, wherein the boiler furnace is provided with a cup-shaped internal wall which delimits a combustion chamber having a first portion with a cross-section increasing simultaneously in width and in height from the burner to a central plane of said combustion chamber and a second portion located beyond said central plane and having a constant width with a decreasing height from said central plane to the flues.

5. A boiler according to claim 1, wherein the boiler furnace is formed of cast iron and wherein the boiler furnace and the heat exchanger each comprise at least one orifice, said boiler further comprising a biconical ring which is forcibly fitted in the two orifices so as to provide a communication between the corresponding jackets provided for the circulation of the heat-transporting fluid.

6. A boiler according to claim 1, wherein the boiler furnace is constructed of sheet steel and comprises an internal wall having a substantially cylindrical portion and a concave bottom wall closing the cylindrical portion.

7. A boiler according to claim 6 and further comprising a connecting pipe to connect the jacket of the heat exchanger to the jacket of the boiler furnace for the circulation of the heat-transporting fluid, said connecting pipe being outside the furnace and opening at the bottom of the heat exchanger into a lateral projection of said exchanger.

* * * * *